US009676196B1

(12) United States Patent
Raoust

(10) Patent No.: US 9,676,196 B1
(45) Date of Patent: Jun. 13, 2017

(54) WIPER SYSTEM FOR CLEANING INKJET PRINTHEADS IN INKJET PRINTERS

(71) Applicant: Xerox Corporation, Norwalk, CT (US)

(72) Inventor: Pascal Raoust, Cadenet (FR)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/228,393

(22) Filed: Aug. 4, 2016

Related U.S. Application Data

(60) Provisional application No. 62/369,886, filed on Aug. 2, 2016.

(51) Int. Cl.
*B41J 2/165* (2006.01)

(52) U.S. Cl.
CPC ..... *B41J 2/16535* (2013.01); *B41J 2/16552* (2013.01); *B41J 2/16544* (2013.01)

(58) Field of Classification Search
None
See application file for complete search history.

(56) References Cited

U.S. PATENT DOCUMENTS

| | | | | |
|---|---|---|---|---|
| 6,343,850 | B1 | 2/2002 | Domagall | |
| 6,921,146 | B2 | 7/2005 | Wouters | |
| 7,188,927 | B2 | 3/2007 | Anderson, Jr. et al. | |
| 7,210,761 | B2 | 5/2007 | Mott et al | |
| 7,815,282 | B2 | 10/2010 | Hibbard et al. | |
| 8,313,165 | B2 | 11/2012 | Hibbard et al. | |
| 8,591,001 | B2 | 11/2013 | Aude | |
| 2001/0055043 | A1* | 12/2001 | Wanibuchi | B41J 2/16517 347/33 |
| 2003/0081054 | A1* | 5/2003 | Nakagawa | B41J 2/16547 347/33 |

* cited by examiner

*Primary Examiner* — Lisa M Solomon
(74) *Attorney, Agent, or Firm* — Maginot Moore & Beck LLP

(57) ABSTRACT

A wiper configuration enables a single wiper to clean a faceplate of a printhead in a printer without requiring solvent to prepare the printhead faceplate. The wiper configuration includes a wiper having a hooked end, a mounting bar, and a reinforcing bar. The wiper has two flanges that form a recess that receives the mounting bar so the wiper can be mounted to the mounting bar without the use of threaded members or other fasteners. A pivot in the mounting member is positioned at a predetermined distance from the hooked end of the wiper that is approximately ten times the radius of the internal curvature of the hooked end.

16 Claims, 7 Drawing Sheets

WIPER SYSTEM FOR CLEANING INKJET PRINTHEADS IN INKJET PRINTERS

TECHNICAL FIELD

This disclosure relates generally to inkjet printers, and more particularly, to maintenance systems for cleaning printheads in inkjet printers.

BACKGROUND

Inkjet printers have one or more printheads that eject drops of liquid material, referred to generally as ink, onto a substrate or previously ejected drops of material. Each printhead includes a plurality of inkjets typically arranged in an array. Each inkjet has a nozzle that communicates with an opening in a faceplate of the printhead to enable one or more drops of material to be ejected from the inkjet and through the opening with which the inkjet nozzle communicates in the faceplate. The inkjets can be implemented with a variety of different configurations known to those skilled in the art. Some well-known configurations use piezoelectric and thermal ejectors in the inkjets.

Some of the ink ejected from the inkjets adheres to the faceplate and can collect dust and other debris. If the ink and debris are not removed from the faceplate, then the residual ink and debris may block one or more openings in the faceplate. Printhead cleaning is typically performed within a maintenance station mounted within the printer chassis so the printhead and maintenance station can be moved relative to one another for cleaning. In some maintenance stations, an applicator wipes the faceplates of the printheads with a non-volatile solvent to liquefy the residual ink. Then, a pair of wipers move across the faceplates. The first wiper helps spread the solvent over the faceplate and loosen the debris from the faceplate. The second wiper separates the residual ink and the debris from the faceplate and moves the residual ink, debris, and solvent into a waste receptacle.

These maintenance stations, however, suffer from a number of limitations. For one, they require a supply of non-volatile solvent and an applicator to wipe the faceplate with the solvent. The applicator and the solvent add expense to the printer. Additionally, an actuator and mechanical linkage are needed to move the applicator. Another limitation is the need to have a pair of wipers, each of which provides a different function. Thus, one wiper may wear at a faster rate. To simplify repair of the maintenance station, when one wiper requires replacement, both wipers are replaced. Thus, a portion of the life of one wiper is wasted and the expense of maintaining the printer is increased.

Another type of printhead wiping system is disclosed in U.S. Pat. No. 8,591,001. This system includes a pair of wipers that are operated to clean different portions of the same printhead. One wiper is raised to engage a faceplate of a printhead at a first location and then the wiper is moved across a portion of the printhead to wipe a portion of the nozzle openings in the faceplate. The wiper is then moved out of engagement with the faceplate and the other wiper is raised into engagement with the faceplate at a second location. The other wiper is then moved across another portion of the printhead to wipe another portion of the nozzle openings in the faceplate. This wiper is then lowered and the printhead is returned to normal printing operations. The limitations of this type of printhead wiping system include difficulty in adjusting the position of the wiper ends as the wipers wear, the difficulty in holding the wiper adjustments, and the complicated manner of mounting the wipers to support members in the wiping system.

What is needed is a maintenance station that enables efficient cleaning of printheads in an inkjet printer without requiring solvent application or complicated mounting of the wipers in the cleaning system.

SUMMARY

A printhead wiping system that enables efficient cleaning of printheads in the printer without using solvents and simplified mounting of wipers includes a wiper having a body that terminates in a hooked end, a pair of flanges extending from the wiper body that are separated from one another by a predetermined distance, each flange having a curved end to form a C-shaped opening between the flanges, and a pointed end positioned on the wiper body at an end opposite the hooked end and adjacent to one of the flanges, a mounting member positioned within the C-shaped opening between the flanges, the mounting member having a length along its longitudinal axis that is longer than a length of the wiper body along its longitudinal axis, a mechanism operatively connected to the mounting member to move the hooked end of the wiper body into and out of engagement with a faceplate of a printhead, and a translating mechanism to move the hooked end of the wiper body along the faceplate of the printhead to wipe at least a portion of the faceplate.

A single wiper that can efficiently clean printheads in an inkjet printer without a solvent and enables simplified wiper mounting includes a wiper body that terminates in a hooked end, and a pair of flanges extending from the wiper body that are separated from one another by a predetermined distance, each flange having a curved end to form a C-shaped opening between the flanges.

BRIEF DESCRIPTION OF THE DRAWINGS

The foregoing aspects and other features of a printhead wiping system that efficiently cleans printheads in the printer without solvents are explained in the following description, taken in connection with the accompanying drawings.

DETAILED DESCRIPTION

Figure 1:
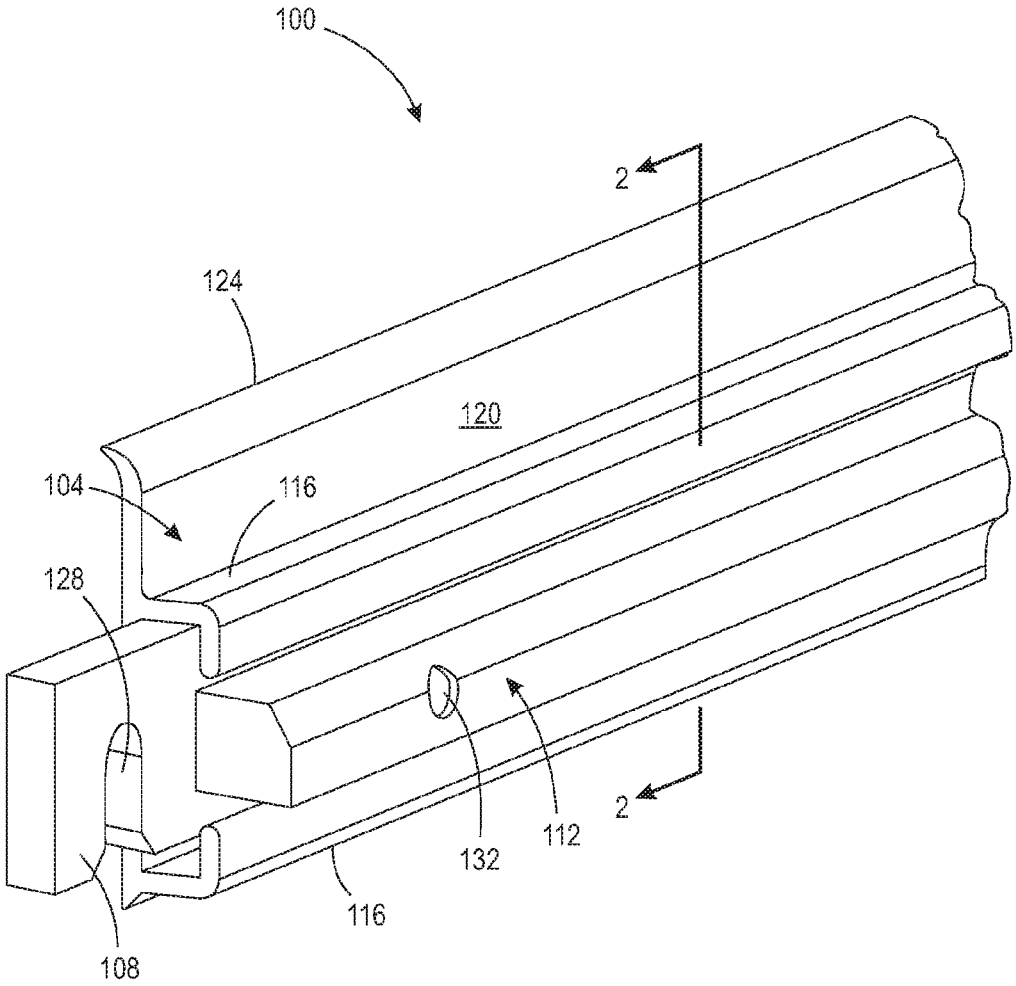
FIG. 1 is a perspective view of one end of a wiper assembly configured to clean the faceplate of one or more printheads in an inkjet printer.

For a general understanding of the present embodiments, reference is made to the drawings. In the drawings, like reference numerals have been used throughout to designate like elements.

FIG. 1 depicts a wiper assembly 100 that can clean a portion of a single printhead or a plurality of printheads. The printheads extend in a cross-process direction across a print zone in an inkjet printer. The wiper configuration 100 includes a wiper 104, a mounting member 108, and, in some embodiments, a reinforcement member 112. The wiper 104 has a pair of flanges 116 and a wiper body 120 that terminates in a hooked end 124. As used in this document, a hooked end means the terminating end of the curved portion of a substantially J-shaped wiper. The mounting member 108 is a generally rectangular member that is longer along its longitudinal axis than the longitudinal axis of the wiper 104. At each end of the mounting member 108 is a U-shaped slot 128.

Figure 2A:
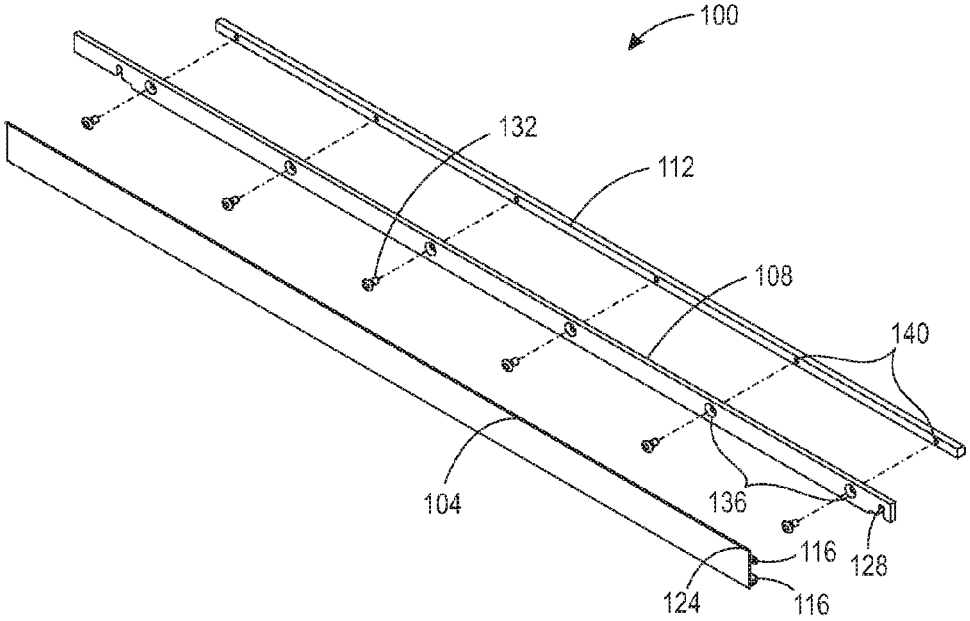
FIG. 2A is a perspective view of a wiper assembly having a wiper, a mounting member, and a reinforcing member.

FIG. 2A shows a wiper assembly 100 that includes the reinforcing member 112. The reinforcing member 112 is added to the mounting bar 108 to increase the stiffness of the mounting bar 108 and the wiper 104 when the longitudinal length of the wiper 104 is about five times or more greater than the height of the wiper 104. At longitudinal lengths less than about five times the height of the wiper 104, the reinforcing member 112 is not required. The reinforcing member 112 can be formed integrally with the mounting member 108. Alternatively, as shown in FIG. 2A, the reinforcing member 112 can be separately made and mounted to the mounting member 108 using threaded members 132, which are passed through mounting holes 136 in mounting bar 108 and then screwed into a threaded holes 140 in the reinforcing member 112. The mounting holes 136 are counter-sunk to enable the head of the threaded member to be flush with the surface of the mounting member 108. The reinforcing member 112 is approximately the same length as the wiper 104 along its longitudinal axis. This length enables access to the U-shaped slot 128 of the mounting member 108 for the connecting of the mounting member 108 to the actuator 204 as explained below.

Figure 2B:
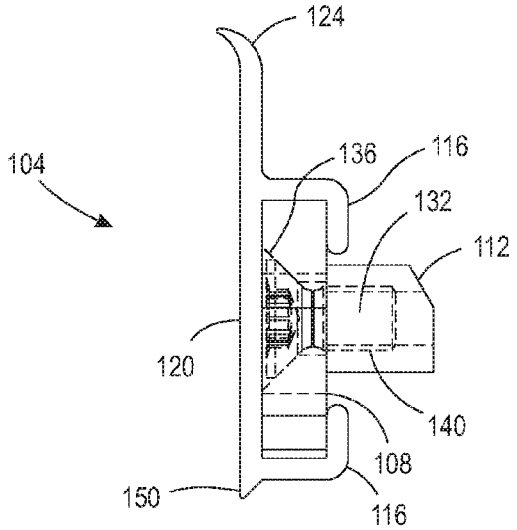
FIG. 2B is a cross-sectional view of the wiper assembly shown in FIG. 2A after it has been assembled.
Figure 3:
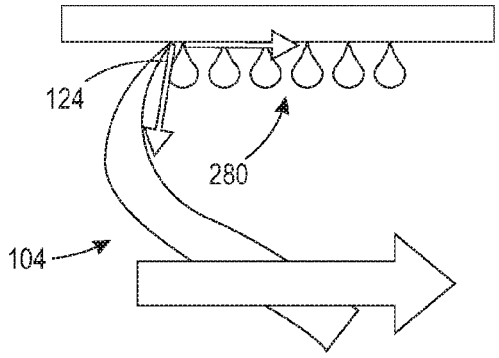
FIG. 3 depicts the hooked end of the wiper in FIG. 1 remaining in engagement with a surface as the wiper moves across the surface.

The wiper 104 is made of somewhat flexible material that can bend as the actuator rotates the wiper into the faceplate of a printhead. Such materials include urethanes, such as polyether urethane, silicone, and other similar polymer materials. In one embodiment, the wiper is made of a thermoplastic polyurethane, such as thermoplastic polyurethane 60 Shore A. The durometer of the material is in the range of about 50 to 70 Shore A and in most embodiments is in the range of about 55 to 65 Shore A. The material is sufficiently resilient that it retains the curve in the hooked end 124 as the wiper is moved along the faceplate of a printhead. As shown in FIG. 3, this resilience enables the hooked end 124 to be the only portion of the wiper 104 that remains in engagement with the faceplate of the printhead as the wiper moves in the direction indicated by the arrow. The curved portion of the hooked end 124 enables the wiper to catch the liquid drops 280 being removed from the faceplate by the hooked end 124 and direct the fluid along the face of the body 120 of the wiper 104 to a pointed end 150 on the wiper 104 (FIG. 2B). The pointed end 150 directs the collected fluid from the body 120 of the wiper 104 into a waste receptacle positioned proximately to the pointed end 150.

The cross-section of the wiping blade shown in FIG. 2B is the same along the entire length of the wiper. The design of the wiper integrates features that enable positioning and locking of the wiper about the mounting member 108 as well as providing reliable cleaning of printhead faceplates. Consequently, an extrusion manufacturing process can be used to manufacture the wiper 104. Extrusion of the wiper 104 substantially reduces manufacturing costs and is very versatile since different lengths of wiping blades can be cut from a single extrusion to provide wipers having a length from a few millimeters to more than one meter. Extrusion of a wiper is much simpler than known wiper manufacturing methods, which include cutting wipers from polymer sheets or molding or over-molding wipers on metal supports.

To mount the wiper 104 to the mounting member 108, the flanges 116 are configured to form a C-shaped opening. This opening is manipulated to fit the mounting member 108 within the opening between the flanges 116 to enable the end of the wiper 104 to be positioned at a consistent location. A cross-sectional view of the wiper 104 mounted about the mounting member 108 is shown in FIG. 2B. The unattached ends of the flanges 116 curve around the top and bottom of the mounting member 108 to help secure the wiper 104 about the mounting member 108. The wiper is flexible enough to enable the flanges 116 to be distended to receive the mounting member 108 and, once the mounting member 108 is received in the space between the flanges 116, they return to their original positions to secure the wiper 104 about the mounting member 108. The configuration of the flanges in this manner enable the wiper to be mounted to the mounting member 108 without requiring installation hardware, machining of holes in the mounting member, or special tools to manipulate fasteners to hold the wiper to the mounting bar.

Figure 4A:
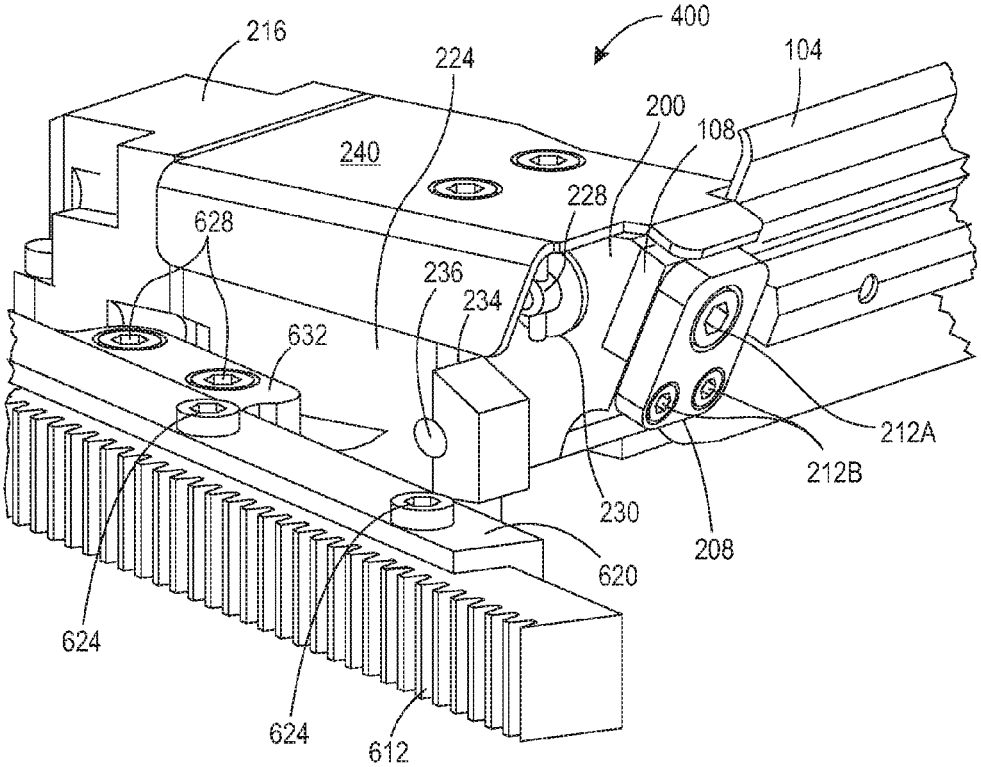
FIG. 4A is a perspective view of a rotating mechanism operatively connected to the wiper assembly of FIG. 2A to lower and raise the wiper with reference to a printhead faceplate.

A wiper rotating mechanism 400 is shown in FIG. 4A. As shown in that figure, a mounting lock 208 has two lower openings that receive threaded members 212B that mate with threaded openings in the bracket 200 to secure the mounting lock 208 to the bracket 200. The upper opening in mounting lock 208 receives threaded member 212A that passes through the mounting slot 128 (FIG. 1) and into a threaded hole in bracket 200. Mounting member 108 is interposed between mounting lock 208 and bracket 200 and threaded member 212A secures the mounting member 108 to the bracket 200.

Figure 4B:
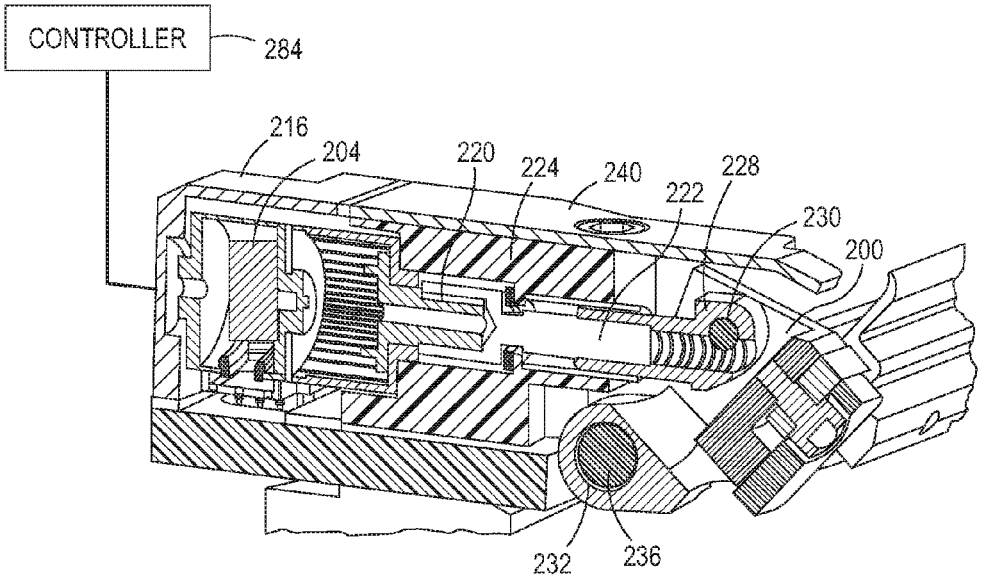
FIG. 4B is a cross-sectional view of the rotating mechanism of FIG. 4A.
Figure 4C:
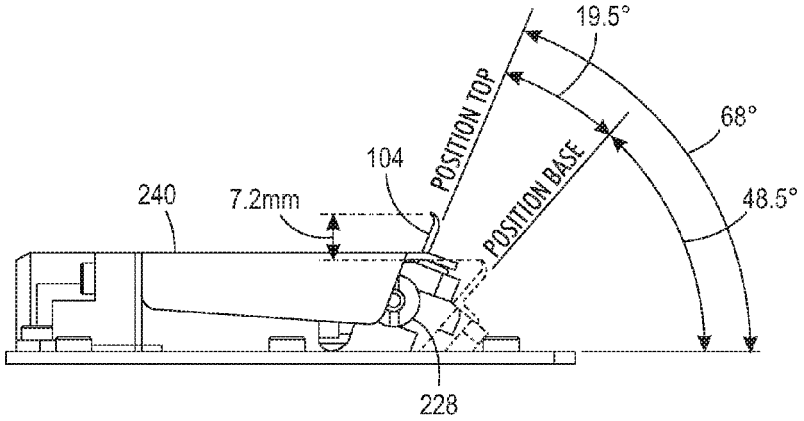
FIG. 4C illustrates the pivoting of the wiper end in the rotating mechanism operatively connected to the wiper assembly of FIG. 2A to lower and raise the wiper with reference to a printhead faceplate.

A cross-sectional view of the rotating mechanism 400 is shown in FIG. 4B. The housing 224 abuts an actuator housing 216, which covers the actuator 204. Drive 220 of the actuator 204 has an extension 222 that mates with an opening in member 228, which is secured to the bracket 200 with pin 230. Bracket 200 includes a pivot opening 232 that aligns with opening 234 in the actuator housing 224 (FIG. 4A) so a pivot member 236 is inserted in the aligned openings to enable bracket 200 to rotate about the pivot member 236 with respect to the housing 224. This configuration enables the actuator 204 to rotate the drive 220, which pushes on the extension 222 and the bracket 200 to rotate the bracket 200 in the clockwise direction and pivot the wiper end 124 away from its top position shown in FIG. 4C. The actuator 204 reverses the drive 220 to retract the extension 222 and the bracket 200 to rotate the bracket 200 in the counterclockwise direction and pivot the wiper end 124 from its bottom or base position to its top position as shown in FIG. 4C. As depicted in FIG. 4C the rotation of the bracket 200 moves the wiper end 124 through a vertical distance of 7.2 mm and through an arc of 19.5 degrees, although other dimensions and geometries can be used. A cover 240 covers the housing 224, the bracket 200, and an end portion of the mounting bar 108 (FIG. 4A). The actuator 204 is operatively connected to a controller 284 that operates the actuators 204 in the rotating mechanisms 400 in a printhead wiping assembly 600 as described below to clean printheads within a printer. As used in this document, "mechanism" means one or more components configured to perform some function. A mechanism can include more than one mechanism cooperatively assembled to perform the function.

Figure 5:
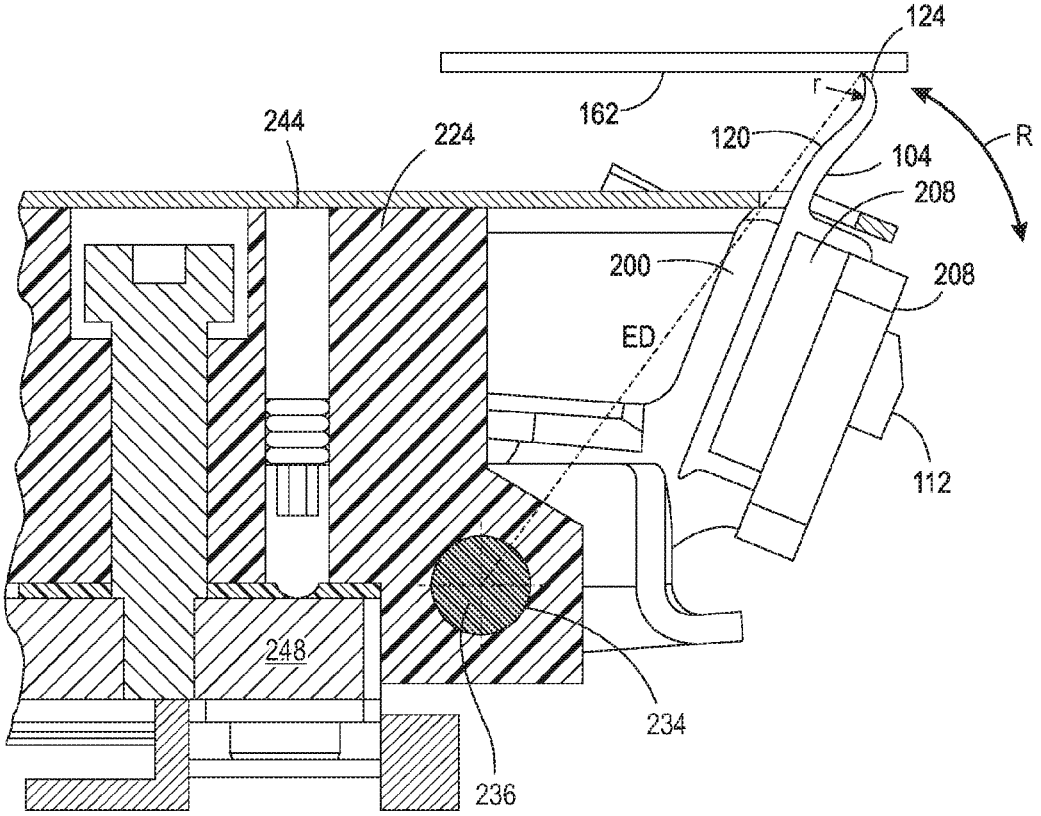
FIG. 5 illustrates the relationships between a pivot member and the hooked end of the wiper assembly shown in FIG. 2A.

As shown in FIG. 5, the bracket 200 and the mounting member 108 secured to the bracket by the lock 208 rotate about the pivot member 236 to rotate the wiper 104 towards and away from the faceplate 162 as indicated by the curved double-headed arrow R in FIG. 5. The distance ED, which extends from the edge of the hooked end 124 to the center of the pivot member 236, is approximately ten times the radius r of the internal curvature of the hooked end 124. This distance enables the wiper body 120 to bend sufficiently that only the tip of the hooked end 124 remains engaged with the faceplate 162 without flattening the tip of the end 124. The reinforcing member 112 helps maintain the stability of the mounting member 108 within the recess between the flanges 116 when the wiper length is about five times or more greater than the height of the wiper as noted previously. Thus, the member 108 and the wiper 104 do not distort as the actuator 204 rotates the wiper 104 into the faceplate 162 or as the wiper is moved along the faceplate 162 to wipe the faceplate as explained in more detail below. FIG. 5 also depicts a threaded member 244 that bi-directionally rotates to adjust the vertical position of the mounting bar 108 and wiper 104. As the member 244 rotates, it moves actuator housing 224 vertically with reference to support 248 to alter the vertical position of the wiper end 124.

The liquid drops 280 shown in FIG. 3 are ink drops purged from the printhead or printheads before the actuator 204 rotates the wiper 104 into engagement with the faceplate 162. Purging is typically achieved by applying a hydraulic pressure to the ink reservoir within a printhead to urge ink through the inkjets of the printhead and out through the nozzle openings in the faceplate. This purged ink acts like a solvent on the faceplate to liquefy the residual ink and provide a carrier for the debris on the faceplate. The configuration of the wiper as set forth above enables the hooked end of the wiper to collect the purged ink, residual ink, and debris and direct them to the pointed end 150 so they can be removed from the printhead.

Figure 6:
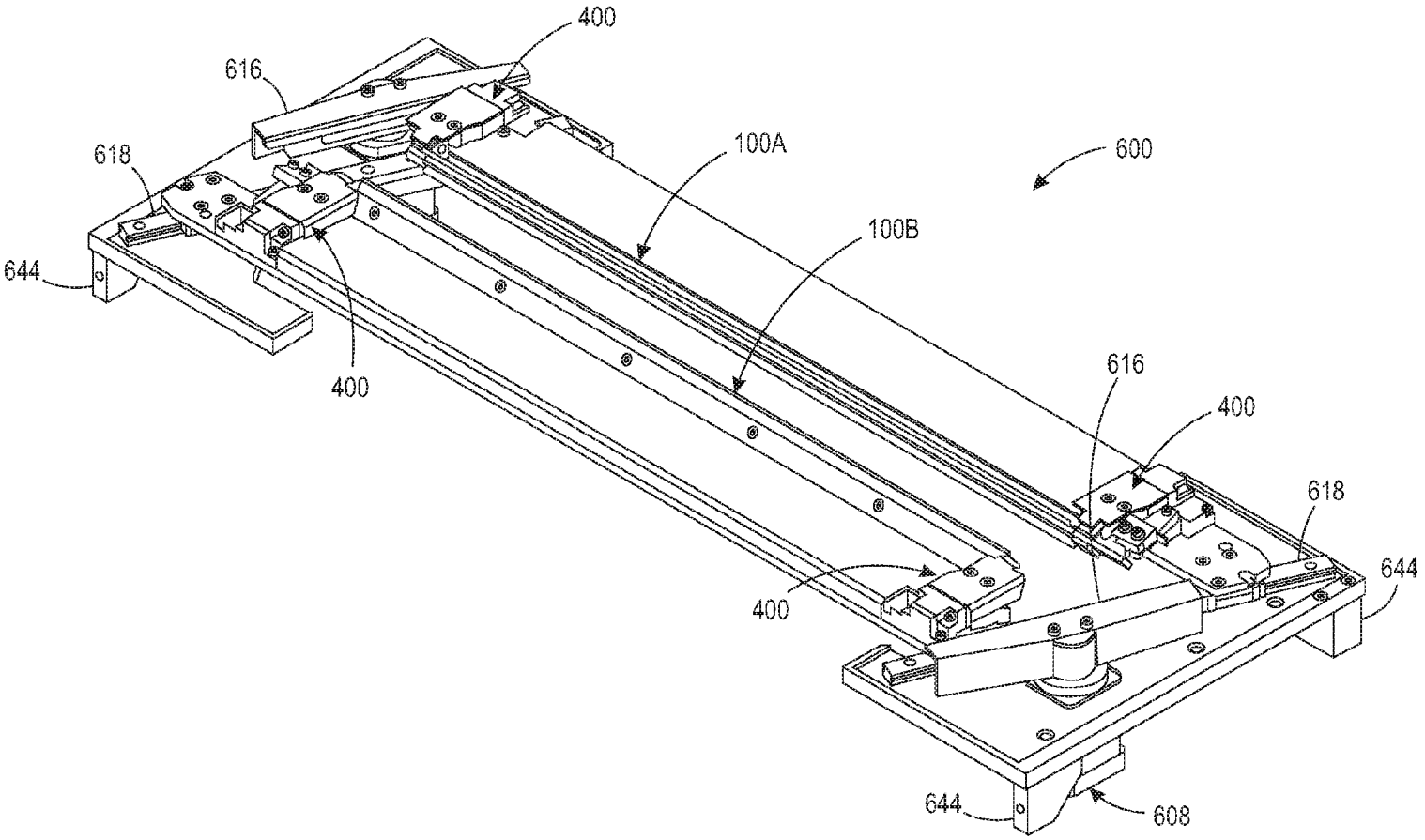
FIG. 6 is a perspective view of a printhead wiping assembly that includes the rotating mechanism of FIG. 4A to 4C and a pair of wiper assemblies shown in FIG. 2A.

A printhead wiping assembly 600 is shown in FIG. 6. The assembly 600 includes two wiper assemblies 100A, 100B with each wiper assembly having a rotating mechanism 400 at each end. The rotating mechanisms 400 operatively connected as described above to wiper assembly 100B rotate the wiper assembly 100B so clockwise rotation of the wiper assembly 100B lowers the wiper end 124 and counterclockwise rotation raises the wiper end 124. The rotating mechanisms 400 operatively connected as described above to wiper assembly 100A rotate the wiper assembly 100A so counterclockwise rotation of the wiper assembly 100B lowers the wiper end 124 and clockwise rotation raises the wiper end 124. To move an engaged wiper end 124 in the process direction along the faceplate of a printhead, rotating mechanism 400 includes a rack 612 on each end of the mechanism. The rack 612 is shown in more detail in FIG. 4A as being mounted within a bracket 620 by threaded members 624. The bracket 620 is mounted to the rotating mechanism 400 by threaded members 628 that pass through flange 632, which is formed as part of bracket 620, to engage threaded holes in the mechanism 400.

Figure 7:
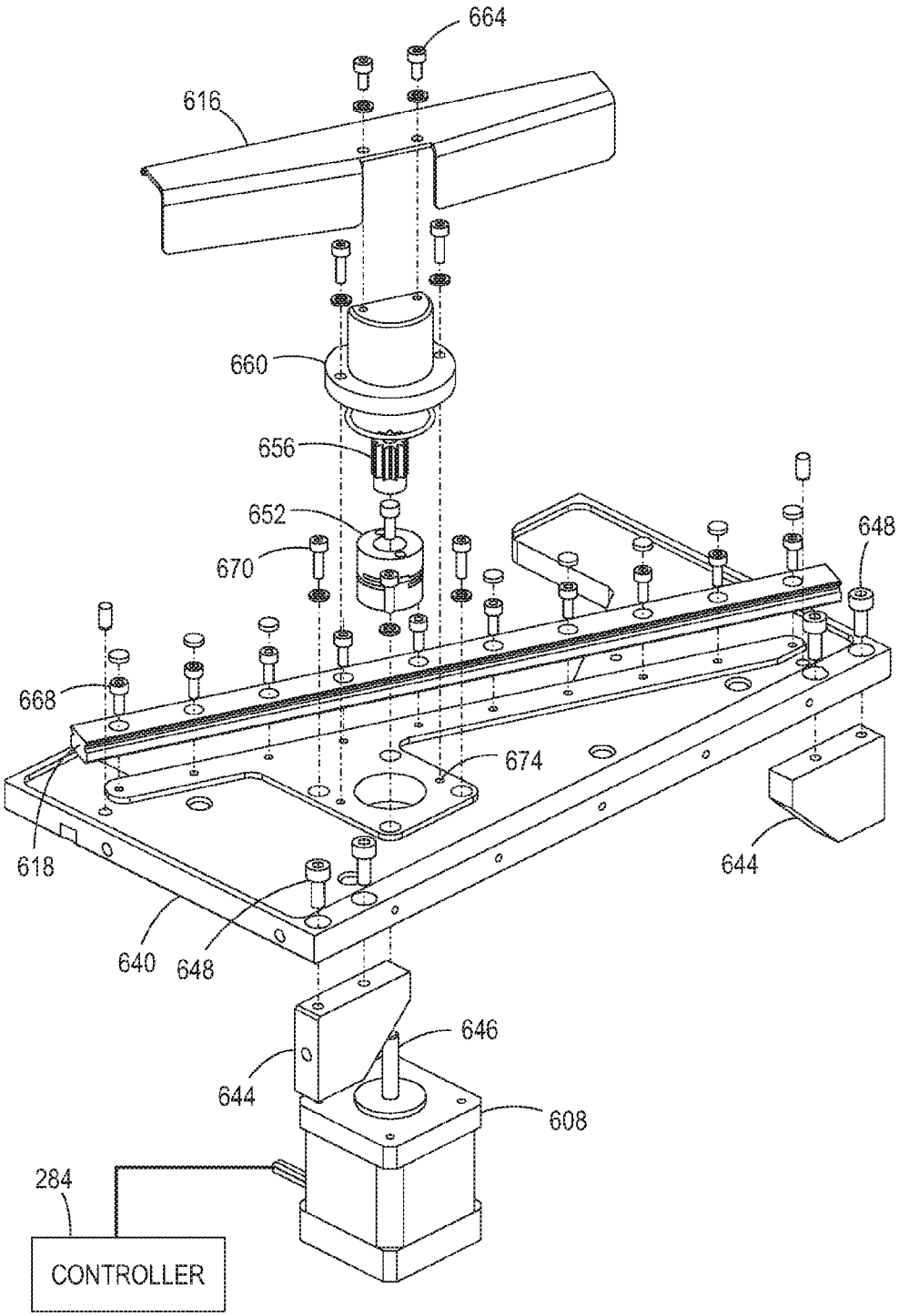
FIG. 7 is an exploded view of the translating mechanism in the printhead wiping assembly of FIG. 6.

With reference to FIG. 6, assembly 600 also includes an actuator 608 on each end of the wiper assemblies 100*a* and 100*b*, although only one actuator 608 is in the view of FIG. 6. The actuator 608 that translates the wiper assemblies 100A and 100B is shown in greater detail in FIG. 7. The actuator 608 is operatively connected to the controller 284 so the controller can operate the actuator to translate the wiper ends 124 along the faceplates of printheads. A transmission component 652 connects the drive 646 of the actuator 608 to a gear 656. The gear 656 is sheltered within a half-cylinder covering 660 to which a rack shield 616 is mounted. Frame supports 644 are mounted with fasteners 648 to frame 640 to help ensure the frame 640 is horizontal. Guide 618 is secured to the support member 674 and frame 640 by fasteners 668. A similar assembly of another actuator and frame on the other end of printhead wiping assembly 600 is also provided. When assembled, each end of the wiper assembly 100*b* is positioned so the brackets 620 slide along the guides 618 at each end and the guides urge the racks 612 in the rotating mechanisms 400 at each end to remain engaged with the gears 656 within the half-cylinder coverings 660. The bi-directional rotation of drives 646 by actuators 608 translate the rack 612 and the wiper assembly 100B connected to the rack 612 in a linear path. The ends of the wiper assembly 100A are similarly configured.

Once printhead wiping assembly 600 is assembled and installed within a printer, the controller 284 is operatively connected to the actuators 608 in the printhead wiping assembly and to the actuators 204 in the rotating mechanisms 400 at each end of the wiper assemblies 100A and 100B. The controller 284 is configured with programmed instructions or instructions remotely transmitted to the printer that are stored in a memory operatively connected to the controller. The controller 284 executes the programmed instructions to operate the actuators 204 in the rotating mechanisms 400 of wiper assemblies 100A and 100B to rotate the wiper ends 124 to their bottom position as shown in FIG. 4C. When the assembly is positioned opposite one or more printheads, the controller 284 operates the actuators 204 at each end of both of the rotating mechanisms 400 to rotate the wiper end 124 to a first position that is close, but not touching, the faceplate of the printhead. For example, the wiper end can be positioned approximately 1 mm from the faceplate. Controller 284 then operates the actuators 608 to rotate the gears 656 and translate the racks 612 on one end of each wiper assembly. This movement moves the wiper end 124 close to the faceplate across the printhead to move purged ink drops from the faceplate as the wiper end 124 is translated across the faceplate. Once the wiper assemblies reach the end of their translation path, the controller 284 operates the actuators 608 to return the wiper end 124 to the position at which it began translation of the wiper end. There, the controller 284 operates the actuators 204 in the assembly that contains the wiper end 124 that is close to the faceplate so the wiper end 124 engages the faceplate. The controller 284 then operates the actuators 608 again to translate the wiper end 124 across the faceplate and complete the cleaning of the faceplate as the wiper end engages the faceplate during this movement. The controller then operates the actuators 204 in the rotating mechanisms 400 to lower the wiper end 124 of the engaged wiper assembly to the base position shown in FIG. 4C.

The printhead wiping assembly described above presents a number of advantages of previously known printhead wiping systems. For one, no solvent or solvent applicator is required. This factor simplifies the wiping assembly and does not require two wipers to perform two different functions with regard to the solvent. The wiper described above can be installed on the mounting member without needing special tools or fasteners. Additionally, the vertical position of the wipers can be easily adjusted by turning a threaded member and the adjustment remains stable thereafter.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A wiper comprising:

a wiper body that terminates in a hooked end;

a pair of flanges extending from the wiper body that are separated from one another by a predetermined distance, each flange having a curved end to form a C-shaped opening between the flanges.

2. The wiper of claim 1 further comprising:

a pointed end positioned on the wiper body at an end opposite the hooked end and adjacent to one of the flanges.

3. A printhead wiping assembly comprising:

a wiper having a body that terminates in a hooked end, a pair of flanges extending from the wiper body that are separated from one another by a predetermined distance, each flange having a curved end to form a C-shaped opening between the flanges, and a pointed end positioned on the wiper body at an end opposite the hooked end and adjacent to one of the flanges;

a mounting member positioned within the C-shaped opening between the flanges, the mounting member having a length along its longitudinal axis that is longer than a length of the wiper body along its longitudinal axis;

a mechanism operatively connected to the mounting member to move the hooked end of the wiper body into and out of engagement with a faceplate of a printhead; and a translating mechanism to move the hooked end of the wiper body along the faceplate of the printhead to wipe at least a portion of the faceplate.

4. The printhead wiping assembly of claim 3 further comprising:

a reinforcing member extending from the mounting member between the curved ends of the flanges.

5. The printhead wiping assembly of claim 4 wherein the reinforcing member is mounted to the mounting member with at least one threaded member, a head of the at least one threaded member being adjacent the body of the wiper.

6. The printhead wiping assembly of claim 3 wherein the mechanism that moves the hooked end of the wiper body into and out of engagement with the faceplate of the printhead is a first rotating mechanism.

7. The printhead wiping assembly of claim 6, the first rotating mechanism further comprising:

a bracket operatively connected to the mounting member, the bracket being positioned about a pivot member; and at least one actuator operatively connected to the bracket, the at least one actuator being configured to rotate the bracket about the pivot member to rotate the mounting member and the wiper to engage and disengage the faceplate of the printhead with the wiper.

8. The printhead wiping assembly of claim 7, the mounting member being further configured with a U-shaped at each end, and the assembly further comprising:

a pair of members, each member having at least one opening; and at least a pair of threaded members, one threaded member passes through the at least one opening of one of the members into the bracket to secure one end of the mounting member and wiper to the bracket and the other threaded member passes through the at least one opening of the other one of the members into another bracket of another rotating mechanism to secure the other end of the mounting member and wiper to the other bracket.

9. The printhead wiping assembly of claim 8 wherein a distance from the hooked end of the wiper to the pivot member is approximately ten times a radius of internal curvature of the hooked end of the wiper.

10. The printhead wiping assembly of claim 7, the actuator and the bracket of the first rotating mechanism being further configured to adjust a vertical position of the wiper.

11. The printhead wiping assembly of claim 7, the first rotating mechanism further comprising:

a rack operatively connected to the bracket; and the translating mechanism further comprising:

at least one actuator having a drive and a gear mounted to the drive, the rack of the rotating mechanism being positioned adjacent to the gear to enable the gear to engage the rack and move the bracket along a linear path to wipe the faceplate of the printhead with the wiper.

12. The printhead wiping assembly of claim 11, the translating mechanism further comprising:

a guide positioned to urge the rack to remain in engagement with the gear.

13. The printhead wiping assembly of claim 7 further comprising:

a controller configured to operate the at least one actuator in the first rotating mechanism to rotate the wiper between a first position and a second position and to operate the at least one actuator in the translating mechanism to move the wiper across the faceplate of the printhead when the wiper is at the second position.

14. The printhead wiping assembly of claim 13 further comprising:

another wiper having a body that terminates in a hooked end, a pair of flanges extending from the other wiper body that are separated from one another by a predetermined distance, each flange of the other wiper having a curved end to form a C-shaped opening between the flanges, and a pointed end positioned on the wiper body at an end opposite the hooked end and adjacent to one of the flanges;

another mounting member positioned within the C-shaped opening of the other wiper between the flanges, the mounting member having a length along its longitudinal axis that is longer than a length of the wiper body along its longitudinal axis;

a second rotating mechanism operatively connected to the other mounting member, the second rotating mechanism having at least one other actuator configured to rotate the other wiper between the first position and the second position to move the hooked end of the other wiper body into and out of engagement with the faceplate of the printhead; and the controller being further configured to:

operate the at least one actuator in the first rotating mechanism to rotate the wiper to the first position;

operate the at least one actuator in the second rotating mechanism to rotate the other wiper to the second position;

operate the at least one actuator in the translating mechanism to reverse movement of the other wiper across the faceplate of the printhead when the other wiper is at the second position.

15. The printhead wiping assembly of claim 13 wherein the hooked end of the wiper when the wiper is at the second position is close to the faceplate, but the hooked end does not engage the faceplate.

16. The printhead wiping assembly of claim 13, the controller is further configured to:

operate the at least one actuator in the first rotating mechanism to rotate the wiper to a third position where the hooked end of the wiper engages the faceplate; and operate the at least one actuator in the translating mechanism to move the wiper across the faceplate of the printhead while the hooked end engages the faceplate.

* * * * *